US007189094B2

(12) United States Patent
Ma

(10) Patent No.: US 7,189,094 B2
(45) Date of Patent: Mar. 13, 2007

(54) LAND GRID ARRAY CONNECTOR

(75) Inventor: Hao-Yun Ma, Tu-Cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/293,974

(22) Filed: Dec. 5, 2005

(65) Prior Publication Data

US 2006/0121765 A1 Jun. 8, 2006

(30) Foreign Application Priority Data

Dec. 3, 2004 (TW) ..... 93219494 U

(51) Int. Cl.
*H01R 13/62* (2006.01)

(52) U.S. Cl. ..... 439/331; 439/73

(58) Field of Classification Search ..... 439/73, 439/81, 331, 330

See application file for complete search history.

(56) References Cited

U.S. PATENT DOCUMENTS 5,161,984 A * 11/1992 Taylor et al. ..... 439/73
6,776,625 B2 * 8/2004 Ma ..... 439/73
6,799,978 B2 * 10/2004 Ma et al. ..... 439/73
6,875,038 B1 * 4/2005 McHugh et al. ..... 439/331
6,899,553 B2 * 5/2005 Ma et al. ..... 439/135
6,957,973 B1 * 10/2005 McHugh et al. ..... 439/331

* cited by examiner

*Primary Examiner*—Tulsidas C. Patel
*Assistant Examiner*—Harshad C Patel
(74) *Attorney, Agent, or Firm*—Wei Te Chung

(57) ABSTRACT

An LGA connector (1) includes an insulative housing (2), a stiffener (3) defined around the housing, a clip (4) pivotably engaged on one end of the stiffener, and a lever (5) engaged on an opposite end of the stiffener for fastening the clip onto the housing. The stiffener includes a bottom plate (31) and a plurality of side walls (32) extending from the bottom plate, and the housing includes a plurality of side surfaces aligned with said side walls, each of the side plates (42) defining a pair of slant sides in the free end. The clip includes a pressing plate (41) and a pair of side plates (42) extending from the pressing plate (41). A slot (34) is formed in corresponding position of the bottom plate (31) of the stiffener for accepting the side plate (42) of the clip (4) partly with the slant sides abutting against the inner side of the slot (34) when the clip (4) is rotated to a horizontal closed position.

10 Claims, 6 Drawing Sheets

LAND GRID ARRAY CONNECTOR

BACKGROUND OF THE INVENTION

1. Field of the Invention

The present invention relates to an electrical connector for electrically connecting an electronic package such as an integrated circuit (IC) chip with a circuit substrate such as a printed circuit board (PCB), and particularly to a land grid array connector adapted for receiving a land grid package (LGP) therein and electrically connecting the LGP with a PCB.

2. Description of the Prior Art

Land grid array (LGA) connector for electrically connecting a Land Grid Package (LGP) with a printed circuit board (PCB) is widely used in the field of electrical connectors. The LGA connector typically comprises an insulative housing, a stiffener defined around the housing, a clip pivotably engaged on one end of the stiffener, and a lever engaged on an opposite end of the stiffener for fastening the clip onto the housing. The LGP is clasped between the clip and the housing.

Referring to FIGS. 5–6, a conventional Land Grid Array (LGA) connector is illustrated. The LGA connector 6 comprises an insulative housing 61, a stiffener 62 defined around the housing 61, a metal clip 63 pivotably engaged on one end of the stiffener 62, and a lever 64 engaged on an opposite end of the stiffener 62 for fastening the clip 63 onto the housing 61. The stiffener 62 comprises a bottom plate 621 and four sidewalls 622 therefrom. Said lever 64 is pivotably connected to one sidewall 622 of the stiffener 62, said clip 63 is pivotably connected to the opposite sidewall of stiffener 62 in a moveable manner. The housing 61 is mounted on the bottom plate 621 of the stiffener 62, with a gap between a side surface of the housing 61 and corresponding sidewall 622 of the stiffener 62. The clip 63 has a substantially rectangular configuration, with a window in the middle thereof. The clip 63 comprises a pair of pressing plates 630 and a pair of side plates 632 extending downwardly from each outer edge of the pressing plate 630 respectively, the pressing plates 630 bend downwardly. The lever 64 comprises an operation lever 641 and a perpendicular pressing lever 642 for pressing the clip 63 to clasp the LGP 7 between the clip 63 and the housing 61.

In use, the clip 63 is first rotated to a vertical open position, and the LGP 7 is seated onto a predetermined position of the housing 61. Then the clip 63 is rotated to a horizontal close position. When the middle portions of the two pressing plates 630 of the clip 63 are fittingly rested on LGP 7, the side plate 632 goes into the gap between the side surface of the housing 61 and corresponding side wall 622. When the operation lever 641 is subsequently actuated, the pressing portion 642 presses an end of the clip 63, therefore fastening the housing 61 and LGP 7 between the stiffener 62 and the clip 63.

Because the clip 63 is connected to the stiffener 62 in a moveable manner, the clip 63 is likely to move on the stiffener 62 before the pressing portion 642 is rotated down for fastening an end of the clip 63. As a consequence, middle portions of the two pressing plates 630 of the clip 63 will engage the LGP 7 at a improper position, not at the predetermined middle position of the LGP. In result, when the pressing portion 642 is rotated down for pressing an end of the clip 63, the LGP 7 will tilt, even be damaged because of being pressed at a improper place by the two pressing plates 630.

In view of the above, a new LGA connector which overcomes the above-mentioned disadvantages is desired.

SUMMARY OF THE INVENTION

Accordingly, an object of the present invention is to provide an LGA connector that can prevent the land grid chip (LGP) from tilting or being damaged when LGP is being sandwiched in the LGA connector, therefore ensuring a reliability electrical connection performance between the LGP and the LGA connector.

To achieve the above-mentioned object, an LGA connector in accordance with the present invention comprises an insulative housing, a stiffener defined around the housing, a clip pivotably engaged on one end of the stiffener in a moveable manner, and a lever engaged on an opposite end of the stiffener for fastening the clip onto the housing. The stiffener comprises a bottom plate and a plurality of side walls extending from the bottom plate, and the housing comprises a plurality of side surfaces aligned with said side walls. A gap is formed between corresponding side surface of the housing and side wall of the stiffener. The clip comprises a pair of pressing plates and a pair of side plates extending downwardly from each outer edge of the pressing plate respectively. A slot is formed in corresponding position of the bottom plate of the stiffener for accepting the side plate of the clip partly when the clip is rotated to a horizontal closed position. Thus the clip can no longer move freely on the stiffener in the horizontal direction, that will promise that the pressing plates of the clip press the LGP at a predetermined proper position of the LGP. Therefore ensuring a reliability electrical connection performance between the LGP and the LGA connector.

Other objects, advantages and novel features of the invention will become more apparent from the following detailed description when taken in conjunction with the accompanying drawings, in which:

DETAILED DESCRIPTION OF THE PREFERRED EMBODIMENT OF THE INVENTION

Reference will now be made to the drawings to describe the present invention in detail.

Figure 1:
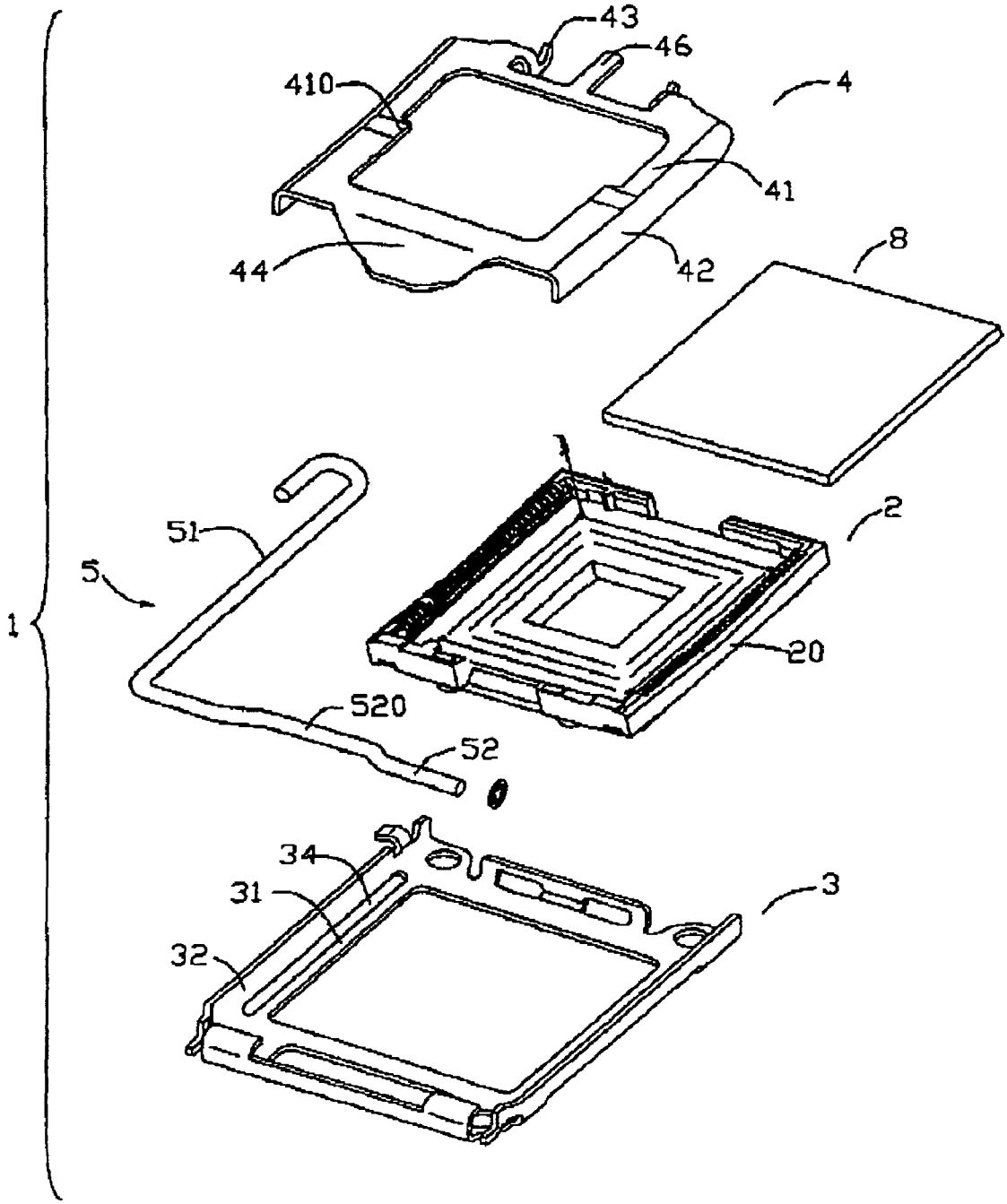
FIG. 1 is an exploded, isometric view of a land grid array connector in accordance with the embodiment of the present invention, together with a land grid package ready to be mounted onto the housing of the land grid array connector.
Figure 2:
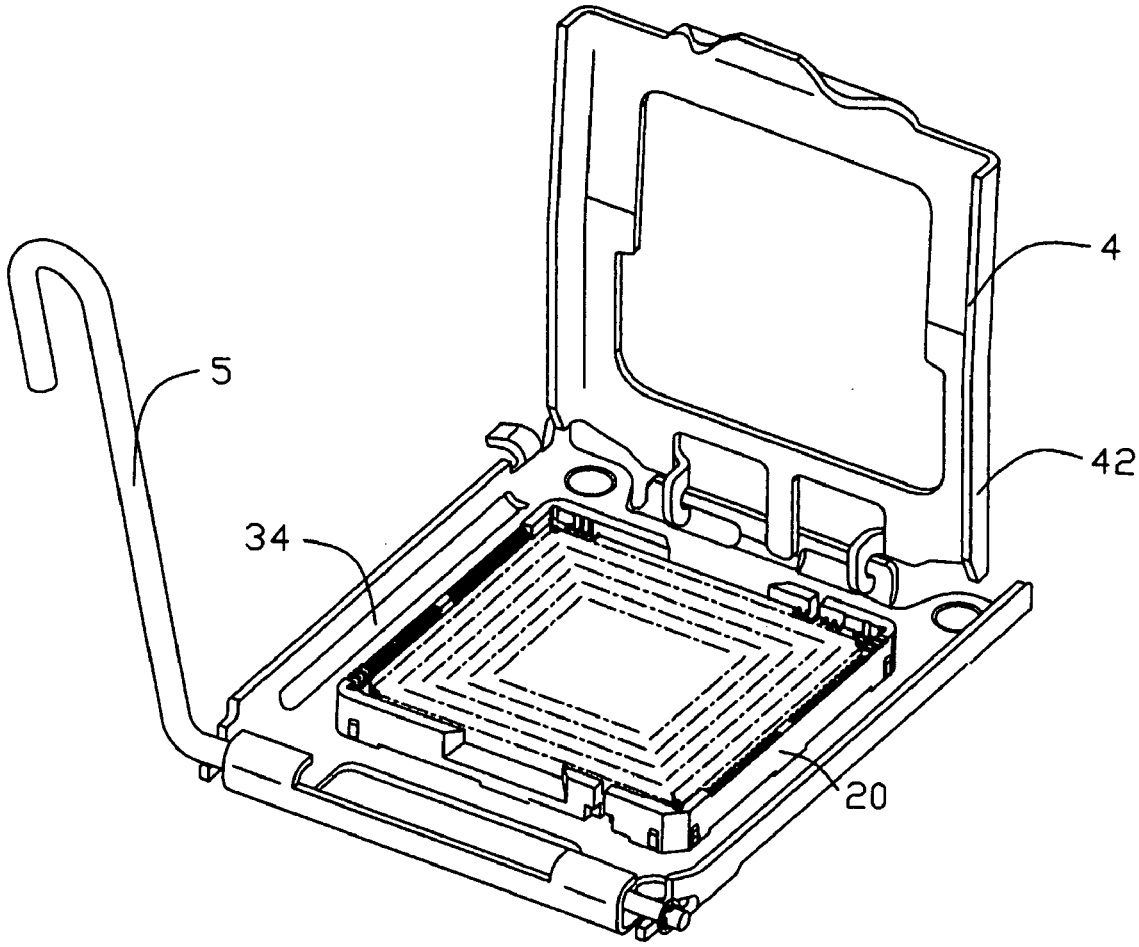
FIG. 2 is an isometric view of the land grid array connector in FIG. 1, with the clip in a vertical open position.
Figure 3:
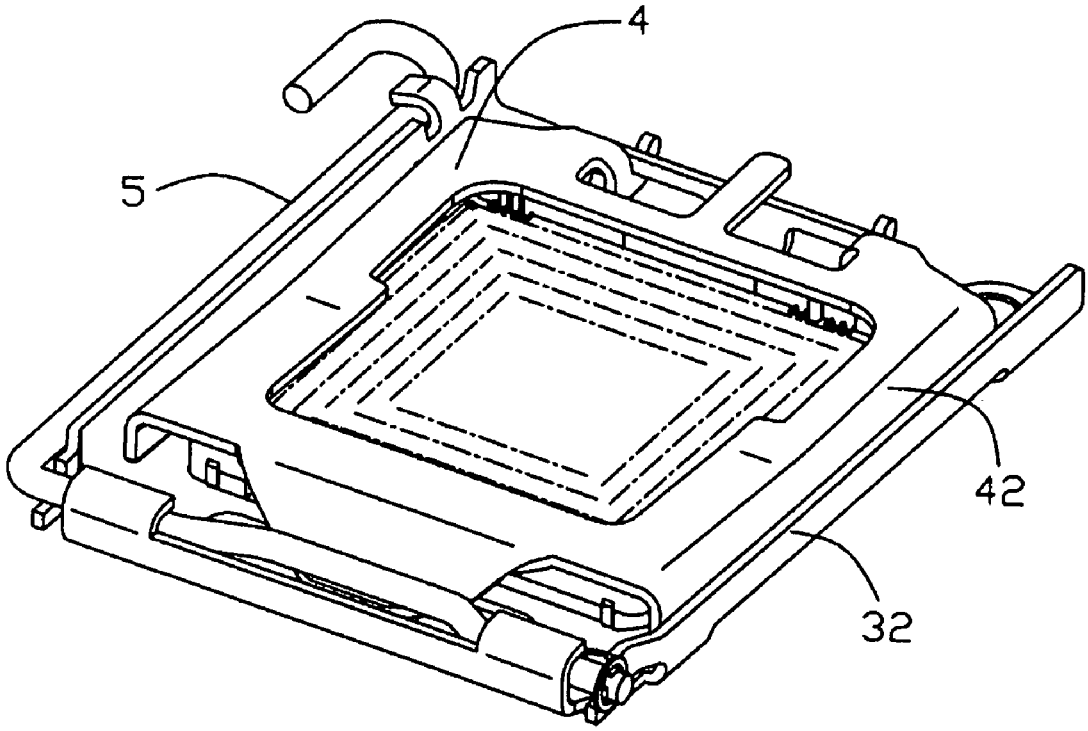
FIG. 3 is an isometric view of the land grid array connector of FIG. 1, with the clip in a horizontal closed position.
Figure 4:
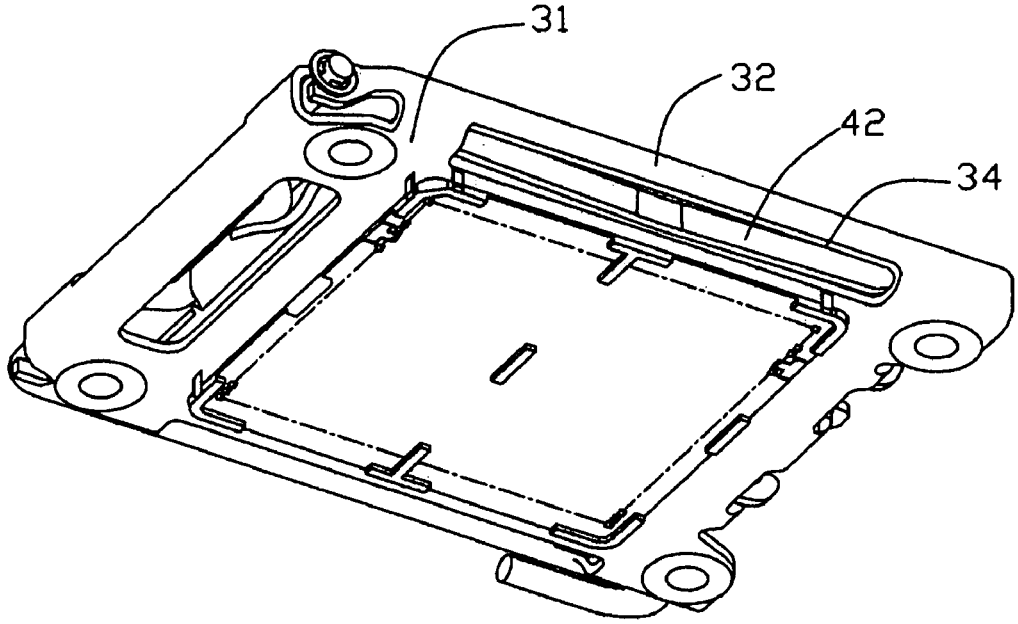
FIG. 4 is an isometric view of the land grid array connector of FIG. 1, showing a side plate of the clip inserting into a slot of stiffener partly.
Figure 5:
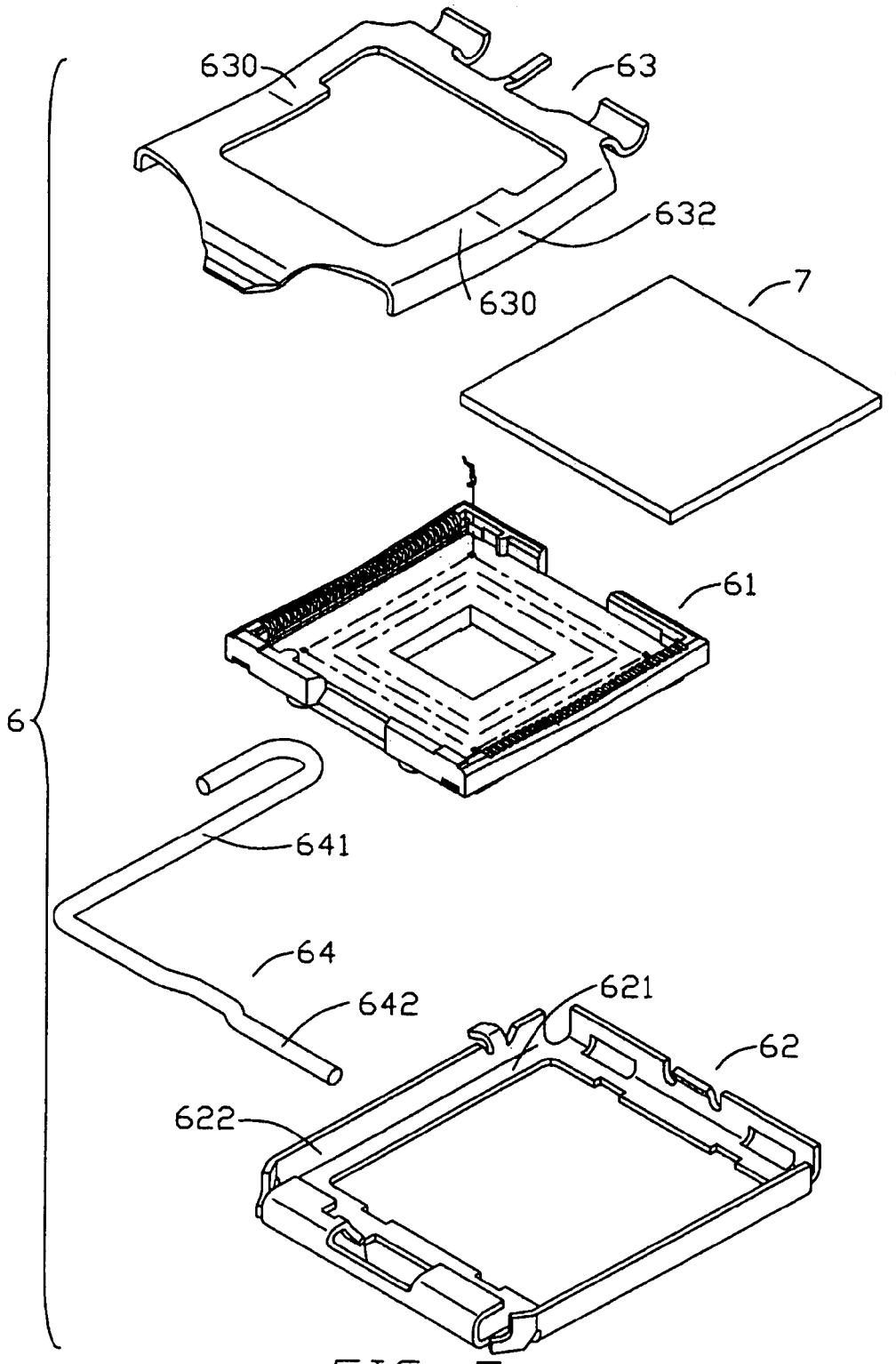
FIG. 5 (PRIOR ART)
FIG. 5 is an exploded, isometric view of a conventional land grid array connector, together with a land grid package ready to be mounted onto the housing of the land grid array connector.
Figure 6:
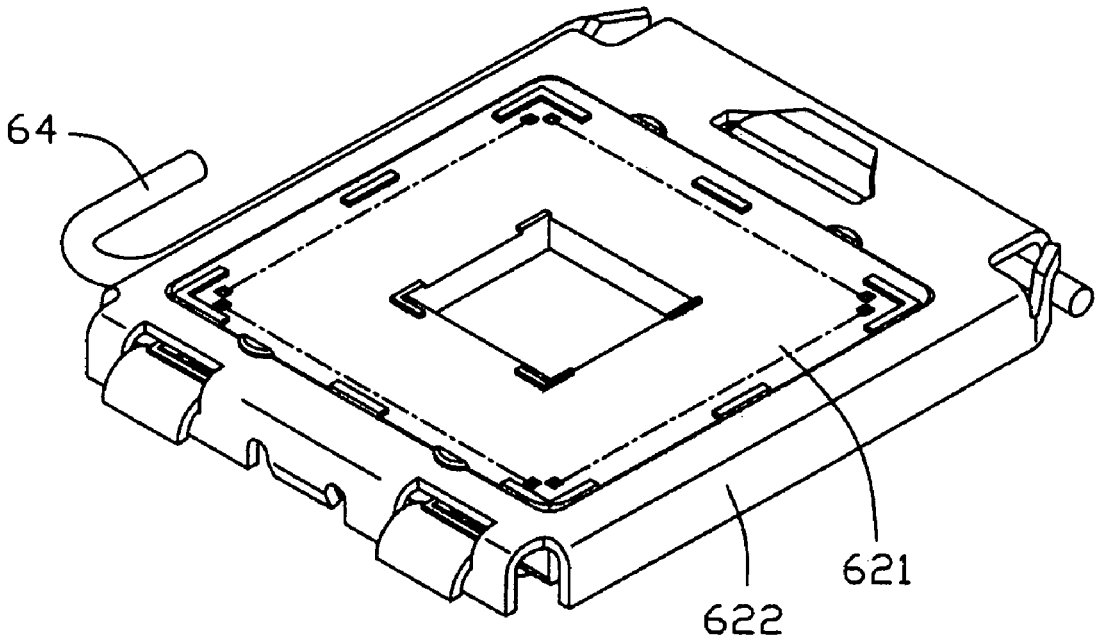
FIG. 6 (PRIOR ART)
FIG. 6 is an inverted isometric view of the land grid array connector in FIG. 5.

Referring to FIGS. 1–4, a land grid array connector 1 in accordance with the embodiment of the present invention comprises an insulative housing 2, a stiffener 3 defined around the housing 2, a metal clip 4 pivotably engaged on one end of the stiffener 3 in a moveable manner, and a lever 5 engaged on an opposite end of the stiffener 3 for fastening the clip 4 onto the housing 2. A Land Grid Package 8 (LGP) is ready to be disposed between the housing 2 and the clip 4, for connecting with the printed circuit board via the connector 1.

The housing 2 has a substantially rectangular configuration with a plurality of side surfaces. A plurality of passageways (not labeled) is defined in the housing 2 for receiving a corresponding number of electrical contacts (not labeled) therein. The stiffener 3 comprises a bottom plate 31 and four side walls 32 comprising a pair of first side walls 322 and a pair of second side walls 324 connecting the first side walls 322 extending upwardly from the bottom plate 31. The bottom plate 31 and side walls 32 cooperatively define a receiving room for accommodating the housing 2. Said clip 4 and lever 5 are pivotably engaged the second side walls 324 of the stiffener 3. The housing 2 is received in the stiffener 3, and the first side walls 322 and corresponding side surfaces each define a gap therebetween. The bottom plate 31 of the stiffener 3 defines slots 34 aligned with said gaps and in communication with the first side walls 322.

The clip 4 is also substantially rectangular. The clip 4 comprises a pair of pressing plates 41 and a pair of side plates 42 extending downwardly from each outer edge of the pressing plate 41 respectively. The length and width of the side plates 42 is set by referring to that of the free ends of the slots for the side plates being closely received in the slots 34. The side plate 42 has also a substantially rectangular configuration with a long outer edge, each of the side plates defining a pair of slant sides in the free end. The free end of the side plate 42 enters into the slot 34 of the stiffener 3 when the clip 4 is rotated to a horizontal closed position. A pair of hooks 43 and an anti-rotation bar 46 therebetween extend from one side of the pressing plate 41 for engaging with corresponding side walls 32 of the stiffener 3, and an extending portion 44 extends from the opposite side of the pressing plate 41 for being pressed by the lever 5. A pair of clasping portions 410 bends toward the housing 2 in a middle of the pressing plate 41 for pressing the LGP 8.

The lever 5 comprises a operation lever 51 and a pressing lever 52 perpendicular to the operation lever 51. The pressing lever 52 defines a middle pressing portion 520 for pressing onto the extending portion 44 of the clip 4, therefore fastening the LPG between the stiffener 3 the clip 4.

In assembly, the housing 2 is mounted in the receiving room formed by the bottom plate 31 and side walls 32 of the stiffener 3, and then the clip 4 and the lever is engaged at two opposite side walls 32 of the stiffener 3, respectively. Another two opposite side walls 32 and corresponding side surfaces of the housing 2 each define a gap therebetween.

In use of the connector 1, the LGP 8 is disposed onto the housing 2. The clip 4 is then rotated downwardly to a horizontal closed position, and the free ends of the side plates 42 enter corresponding slots 34 of the stiffener 3 with the slant sides of the side plates 42 abutting against the inner side of the slots respectively. When the lever 5 is actuated to press the extending portion 44 of the clip 4, the clasping portions 410 of the clip 4 press the LGP 8 down at a predetermined position of at the LGP 8, therefore the LGP 8 is surely sandwiched in the connector 1.

Because the slots 34 are defined in the bottom plate 31 and are aligned with the side plates 42 of the clip 4, when the clip 4 is pressed down by the lever 5, the free ends of the side plates 42 will enter said slots 34 with the slant sides of the side plates 42 abutting against the inner side of the slots 34 respectively, the clip 4 can no longer move freely on the stiffener in the horizontal direction, that will promise that the clasping portions 410 of the clip 4 press the LGP at a predetermined proper position of the LGP, therefore ensuring a reliability electrical connection performance between the LGP and the LGA connector 1.

While preferred embodiment in accordance with the present invention has been shown and described, equivalent modifications and changes known to persons skilled in the art according to the spirit of the present invention are considered within the scope of the present invention as defined in the appended claims.

What is claimed is:

1. A land grid array connector for interconnecting a land grid package and a circuit substrate, the land grid array connector comprising:

a housing comprising a plurality of side surfaces;

a stiffener defined around the housing, the stiffener comprising a bottom plate and a plurality of side walls extending upwardly from the bottom plate;

a clip pivotably engaged in one side wall of the stiffener in a moveable manner, the clip comprising a pressing plate and a pair of side plates extending from two opposite sides of the pressing plate, each of the side plates defining a slant side in the free end;

a lever engaged with another side wall of the stiffener opposite to said one side wall for fastening the clip;

wherein a pair of slots is defined in the bottom plate and aligned for receiving the side plates of the clip, the side plate enters said slot at least partly when the clip is fastened by the lever.

2. The land grid array connector as claimed in claim 1, wherein the slot is defined in the conjunction position of the bottom plate and the side walls extending therefrom.

3. The land grid array connector as claimed in claim 2, wherein when the clip is rotated to a horizontal position, and the free ends of the side plates enter corresponding slots of the stiffener with the slant sides of the side plates abutting against the inner side of the slots respectively.

4. The land grid array connector as claimed in claim 3, wherein a pair of clasping portions are defined in a middle of the pressing plate for pressing the land grid package.

5. The land grid array connector as claimed in claim 4, wherein a pair of hooks is defined at one end of the pressing plate for pivotably engaging wit the stiffener.

6. The land grid array connector as claimed in claim 5, wherein an anti-rotation bar is defined between the hooks.

7. A land grid array connector for interconnecting a land grid package and a circuit substrate, the land grid array connector comprising:

a housing comprising a plurality of side surfaces;

a stiffener defined around the housing, the stiffener comprising a bottom plate with an upper face thereon, and a plurality of side walls extendihg upwardly from the bottom plate and comprising a pair of first side walls and a pair of second side walls;

a clip mounted upon one of said side walls of the stiffener in a moveable manner, the clip comprising a pressing plate and at least one side plate extending downwardly from one side of the pressing plate corresponding to the first side walls;

a lever mounted on another portion of the stiffener for fastening the clip; wherein the side plate extends downwardly beyond the upper face and is closely confined on the stiffener in a horizontal plane; wherein a pair of slots is defined in the bottom plate alligned for receiving the side plates of the clip.

8. A land grid array connector for interconnecting a land grid package and a circuit substrate, the land grid array connector comprising:

a housing comprising a plurality of side surfaces;

a stiffener defined around the housing, the stiffener comprising a bottom plate with an upper thee thereon and a side wall extending upwardly from one front-to-back side of the bottom plate;

a clip mounted upon one of said side walls of the stiffener in a moveable manner, the clip comprising a pressing plate and one side plate extending downwardly from one front-to-back side of the pressing plate, the clip being rotated in a front-to-back direction, from a vertical open position to a horizontal closed position on the stiffener;

a lever mounted on another portion of the stiffener for fastening the clip;

wherein when the clip is rotated to the horizontal closed position on the stiffener, one of said side plate and the side wall is received in a slot which is formed in one of said clip and said stiffener under a condition that the other of said side plate and said side wall is formed by said one of said clip and said stiffener, while said one of said side plate and said side wall is not received in said slot when said clip is rotated to be away from said horizontal closed position; wherein all said slot, said side wall and said side plate extend along the front-to-back direction.

9. The connector as claimed in claim 8, wherein a pair of slots is defined in the bottom plate aligned for receiving the side plates of the clip.

10. The connector as claimed in claim 8, wherein each of the side plates defining a pair of slant sides side in the free end, when the clip is rotated to a horizontal position, and the free ends of the side plates enter corresponding slots of the stiffener with the slant sides of the side plates abutting against the inner side of the slots respectively.

* * * * *